United States Patent [19]

Fujita et al.

[11] Patent Number: 4,992,744

[45] Date of Patent: Feb. 12, 1991

[54] RADIO FREQUENCY LINEAR ACCELERATOR CONTROL SYSTEM

[75] Inventors: Hiroyuki Fujita, Osaka; Akira Hirakimoto, Kyoto, both of Japan

[73] Assignee: Shimadzu Corporation, Kyoto, Japan

[21] Appl. No.: 358,827

[22] Filed: May 30, 1989

[30] Foreign Application Priority Data

May 30, 1988 [JP] Japan ..... 63-132467

[51] Int. Cl.[5] ..... H01J 23/00

[52] U.S. Cl. ..... 328/233; 315/5.42; 331/3

[58] Field of Search ..... 328/233; 313/359.1; 315/111.61, 5.42; 331/3, 94.1

[56] References Cited

U.S. PATENT DOCUMENTS 4,656,394 4/1987 Perraudin ..... 328/233 X 4,700,108 10/1987 Morse ..... 328/233 X 4,713,581 12/1987 Haimson ..... 315/5.42 X

*Primary Examiner*—Donald J. Yusko

*Assistant Examiner*—Michael Horabik

*Attorney, Agent, or Firm*—Koda and Androlia

[57] ABSTRACT

A control system for controlling a radio frequency resonant cavity type linear accelerator so as to be power-supplied always at a resonance frequency of a resonat cavity constituting the accelerator. The system consists essentially of a signal pick-up coil inserted in the resonat cavity, a voltage-controlled oscillator assembly, a phase detector for detecting a phase difference between a signal picked up from the cavity by the signal pick-up coil and an output from the voltage-controlled oscillator assembly. An output from the phase detector controls the voltage-controlled oscillator assembly so as to make it oscillate at a frequency equal to a resonance frequency of the resonant cavity.

2 Claims, 1 Drawing Sheet

RADIO FREQUENCY LINEAR ACCELERATOR CONTROL SYSTEM

BACKGROUND OF THE INVENTION

The present invention relates to a radio frequency linear accelerator control system, and more particularly &o a system for controlling a resonant cavity type radio frequency linear accelerator so as to be power-supplied always at a frequency tuned precisely with the characteristic resonance frequency of the cavity constituting the accelerator.

It is an essential requirement for a resonant cavity type radio frequency linear accelerator that the frequency of the power supplied to the accelerator should coincide with the characteristic resonance frequency of the cavity constituting the accelerator, because a slight discrepancy between the two frequencies causes a severe decrease in the efficiency of the accelerator owing to a high Q-value feature of the resonant cavity. Meanwhile, though the characteristic frequency of a cavity depends sensitively on the cavity dimensions, they vary owing to an inevitable thermal expansion (or contracton) occurring on the cavity during operation.

According to a conventional resonant cavity type radio frequency linear accelerator, to compensate a cavity resonance frequency change caused by thermal expansion, the cavity, which constitutes the accelerator, is generally provided therein with an externally motor-driven inductive tuner. A radio frequency signal picked up by a small pick-up loop inserted in the cavity has its phase compared at a phase detector with that of the radio frequency power being supplied to the cavity. If the resonance frequency characteristic of the cavity (including the inductive tuner) deviates from the frequency of the power being supplied to the cavity, the phase detector outputs a positive or negative signal reflecting the magnitude and direction of the resonance frequency deviation of the cavity. The output from the phase detector operates the motor driving the above inductive tuner so that the tuner makes the resultant resonance frequency of the cavity coincide with the frequency of the power supplied to the cavity. In this manner the resonance frequency of the cavity can be kept at the same frequency as that of the radio frequency power being supplied to the cavity.

However, such a conventional cavity type radio frequency linear accelerator has a disadvantage that, because the resonace frequency compensation is achieved by a mechanical operation of the inductive tuner, it takes a somewhat long time for the tuner to respond to the resonance frequency deviation. This is unfavorable especially when the deviation is large and abrupt. In addition the inductive tuner must be provided with some slidable electrical contact means for making the tuner continue keeping a good and s&able electric contact with the cavity drum during and after being operated. This not only makes the constitution complex, but also increases the manufacturing cost of the apparatus. Further, for a high power accelerator which is expected to have its temperature raised to a very high level resulting in a large thermal expansion of the cavity, one inductive tuner can not cover a desired extent of compensating the resonace frequency deviation of the cavity. In such a case it is necessary to provide a plurality of inductive tuners or a more powerful cooling means to the cavity. Further, in some cases, the inductive tuners themselves must be provided with cooling means. These also make the apparatus more complex and further expensive.

OBJECTS AND SUMMARY OF THE INVENTION

It is an object of this invention to provide an improved resonant cavity type radio frequency linear accelerator control system from which are removed such disadvantages as mentioned above.

Another object of the present invention is to constitute such an improved accelerator control system only with an electric or electronic control means without using any moving or movable mechanical element.

To achieve the above objects, the radio frequency power source to supply power to the resonant cavity constituting an accelerator consists of a voltage-controlled oscillator and a power amplifier, while the resonat cavity, though provided with a signal pick-up loop, has no mechanically movable element such as an inductive tuner. The phase of a signal picked up by the pick-up loop of the cavity is compared at a phase detector, as similarly as in the case of &he conventional control system, with the phase of the radio frequency power being supplied to the cavity, but the control voltage outputted from the phase detector is supplied, in the present invention, to the above voltage-controlled oscillator to control the frequency of the oscillator so as to coincide with the cavity resonace frequency which varies owing to the thermal expansion (or contraction) of the cavity.

According to the present invention, because the control system does not include any mechanical element such as an inductive tuner, the disadvantages previously mentioned in respect of a conventional resonanct cavity type radio frequency linear accelerator are completely removed, and the response to a resonance frequency deviation has no time lag in substance.

Because the control system according to the present invention controls the frequency of the radio frequency power source so as to coincide with the resonance frequency of the cavity constituting an accelerator, the acceleration energy varies a little. However, it is to be noticed especially that there is no problem in applying the present control system to an accelerator as an ion implantor for use in a semiconductor device manufacturing process, that as a particle bombarder for use in surface improvement of materials and the accelerators having similar purposes, because the cavity resonance frequency change due to thermal expansion is generally around 0.5% at largest.

BRIEF DESCRIPTION OF THE DRAWINGS

The present invention may be better understood by referring to the following description when taken in conjunction with the accompanying drawings, in which like reference signs and numerals refer to like constituents in all the figures, and in which.

DETAILED DESCRIPTION OF THE INVENTION

Figure 2:
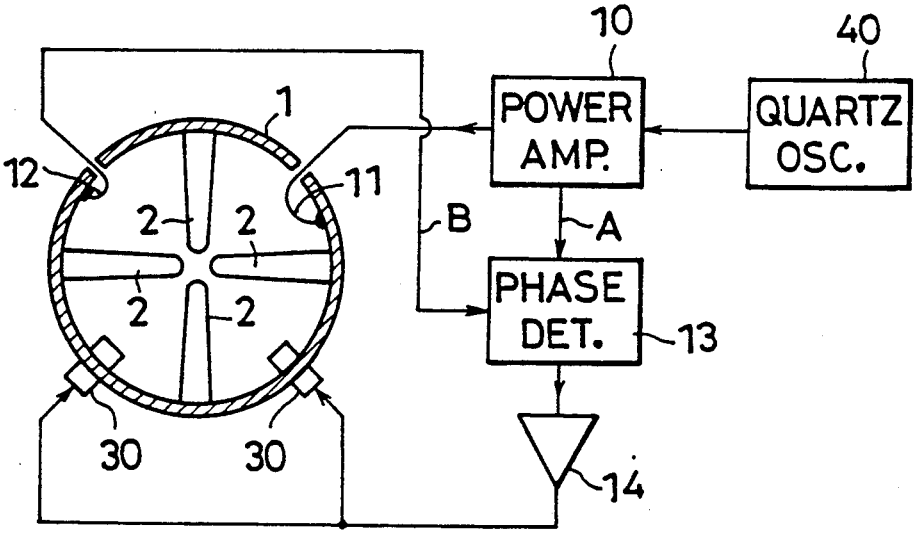
Fig. 2 (PRIOR ART)
FIG. 2 shows a blockdiagrammatical constitution of a conventional accelerator control system.

In advance of the detailed description of the present invention, the previously mentioned conventional accelerator control system is reviewed somewhat in detal in referece to FIG. 2, which shows the (conventional) control system applied to a known radio frequency quadrupole linear accelerator.

In FIG. 2 the radio frequency quadrupole linear accelerator to be controlled is shown as its schematical crosssectional view taken orthogonally to the particle acceleration axis. The accelerator fundamentally consists of a cavity drum 1 and four vanes 2 provided therein, all forming a radio frequency resonant cavity. In each of four quadrant spaces partitioned by the vanes 2 in the cavity drum 1 is provided at least one externally motor-driven inductive tuner 80. In FIG. 2 are shown only two such inductive tuners 80 in two quadrant spaces. The cavity is further provided with a power input loop coupler 11 and a signal pick-up loop coupler 12. The cavity is power-supplied through the input loop coupler is from a radio frequency power amplifier 10 excited by a quartz-controlled oscillator 40. The signal pick-up loop coupler 12 takes out a small amount of power from the cavity and transmits its radio frequency voltage to a phase detector 13 through a route B. To the phase detector 13 is inputted another radio frequency voltage made to branch from the radio frequency power amplifier 10 through a route A. If the resonce frequency of the cavity (consisting of the cavity drum 1 and ;he vanes 2) deviates from the frequency of the power being supplied to the cavity, the phase detector 13 outputs a positive or negative voltage reflecting the magnitude and direction of the resonance frequency deviation of the cavity. The output from the phase detector 13 is amplified by a control voltage amplifier 14, and then fed to the motors 31of the two motor-driven inductive tuners 30 in order to operated them so as to make the cavity resonance frequency return to the frequency of the power being supplied to the cavity.

Figure 3A:
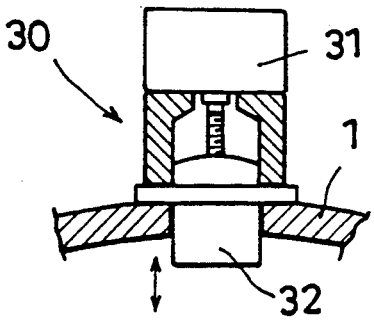
Fig. 3(A) (PRIOR ART)
FIGS. 3(A) and 3(B) shows two kinds of inductive tuner usable in the conventional accelerator control system shown in FIG. 2.
Figure 3B:
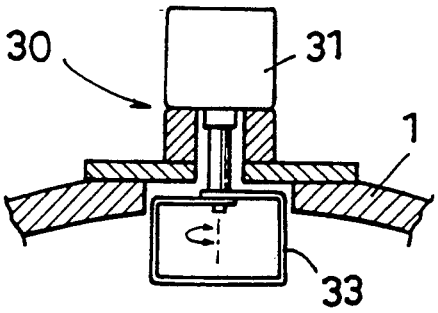
Fig. 3(B) (PRIOR ART)

In FIGS. 3(A) and 3(B) are schematically shown two typical examples of the motor-driven inductive tuners 30 used in the cavity shown in FIG. 2. The tuner shown in FIG. 3(A) is of a cylinder type, and a cylindrical tuner 32 is driven by a motor 31 so as to be inserted into or pulled out from the cavity. The tuner shown in FIG. 3(B) is of a loop type. According to this type a motor 31 rotates a short-circuited loop 33 by a suitable angle in reponse to a cavity resonance frequency deviation. Anyway, any one of these motor-driven mechanical tuners makes the cavity constitution complex. In FIG. 3(A), electrical contact means to be provided between the cylindrical tuner 32 and the cavity drum 1 is omitted for the simplification of the drawing.

Figure 1:
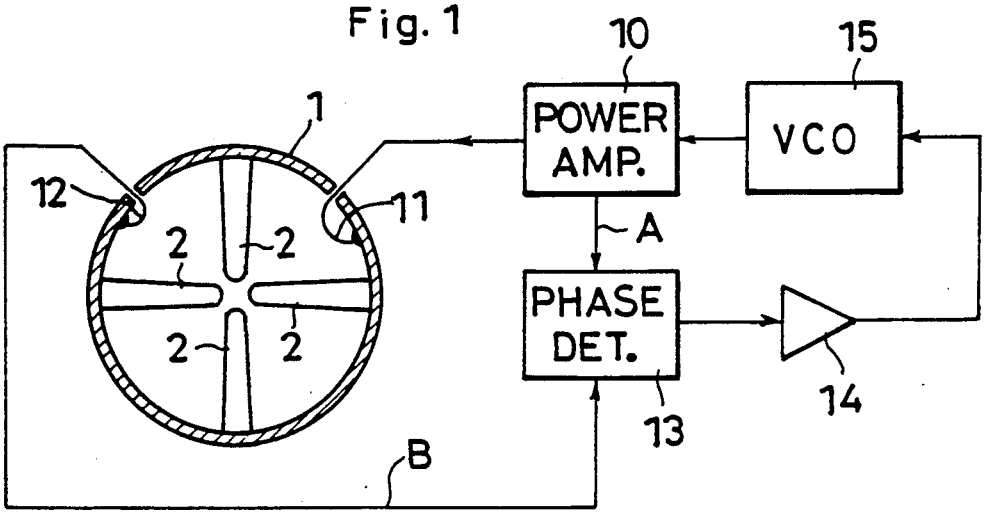
FIG. 1 shows a blockdiagrammatical constitution of an embodiment of the present invention.

In the following an embodiment of the present invention is described on reference to FIG. 1, which shows &hat a control system according to the invention is applied to a radio frequency quadrupole linear accelerator similar to that shown in FIG. 2 except for not being provided with any mechanical means such as motor-driven inductive tuners. According to the present invention, &he quartz-controlled oscilator 40 in FIG. 2 is replaced by a well-known voltage-controlled oscillator 15, while the output from the phase detector 13 is fed to the oscillator 15 through a control voltage amplifier 14*a* in order to control the frequency of the oscilator 15 so as to be tuned to the cavity resonance frequency which varies owing to a thermal expansion (or contraction) of the cavity.

We claim:

1. A radio frequency linear accelerator control system for controlling the frequency of a radio frequency power to a resonant cavity type radio frequency linear accelerator, said system comprising:

a loop coupler for taking out a signal from said resonant cavity type radio frequency linear accelerator;

a voltage-controlled oscillator for feeding a radio frequency power to said resonant cavity type radio frequency linear accelerator; and a phase detector for outputting a frequency control signal according to a relative phase difference between a signal picked up by said loop coupler and a signal made to branch from said radio frequency power being fed to said resonant cavity type radio frequency linear accelerator, said frequency control signal being fed back to said voltage-controlled oscillator for maintaining a frequency of said radio frequency power at a predetermined value.

2. A control system for controlling the frequency of a radio frequency power to a resonant cavity type radio frequency linear accelerator to maintain the frequency of the radio frequency power at a resonant frequency characteristic of a geometry of the accelerator, said control system comprising:

a loop coupler for taking out a signal form said resonant cavity type radio frequency linear accelerator;

a radio frequency power amplifier whose output is supplied to said resonant cavity type radio frequency linear accelerator;

a voltage-controlled oscillator for exciting said radio frequency power amplifier; and a phase detector for outputting a frequency control voltage in accordance with a relative phase difference between a signal picked up by said loop coupler and a signal made to branch from said radio frequency power amplifier, said frequency control voltage being fed back to said voltage controlled oscillator for maintaining said frequency at a predetermined value;

whereby said resonant cavity type radio frequency linear accelerator is always supplied at a frequency equal to a resonant frequency thereof.

* * * * *